US010589396B2

(12) United States Patent
Steinwender

(10) Patent No.: US 10,589,396 B2
(45) Date of Patent: Mar. 17, 2020

(54) PRESSURE SHOE WITH EXPANSION CHAMBER

(71) Applicant: Thielenhaus Technologies GmbH, Wuppertal (DE)

(72) Inventor: Holger Steinwender, Wuppertal (DE)

(73) Assignee: THIELENHAUS TECHNOLOGIES GMBH, Wuppertal (DE)

( * ) Notice: Subject to any disclaimer, the term of this patent is extended or adjusted under 35 U.S.C. 154(b) by 162 days.

(21) Appl. No.: 15/741,956

(22) PCT Filed: Jul. 7, 2016

(86) PCT No.: PCT/EP2016/066123
§ 371 (c)(1),
(2) Date: Jan. 4, 2018

(87) PCT Pub. No.: WO2017/009169
PCT Pub. Date: Jan. 19, 2017

(65) Prior Publication Data

US 2018/0193973 A1 Jul. 12, 2018

(30) Foreign Application Priority Data

Jul. 10, 2015 (DE) ..... 10 2015 008 814

(51) Int. Cl.
*B24B 35/00* (2006.01)
*B24B 21/02* (2006.01)
(Continued)

(52) U.S. Cl.
CPC ..... *B24B 35/00* (2013.01); *B24B 21/02* (2013.01); *B24B 21/16* (2013.01); *B24B 47/06* (2013.01)

(58) Field of Classification Search
CPC ..... B24B 35/00; B24B 21/02; B24B 21/16; B24B 47/06
(Continued)

(56) References Cited

U.S. PATENT DOCUMENTS 3,167,889 A * 2/1965 Jacobi ..... B24B 21/08 451/303
4,084,356 A * 4/1978 Brears ..... B24B 21/00 144/355
(Continued)

FOREIGN PATENT DOCUMENTS

DE 19650155 C1 6/1998
DE 19738818 A1 3/1999
(Continued)

*Primary Examiner* — George B Nguyen
(74) *Attorney, Agent, or Firm* — Johnson, Marcou, Isaacs & Nix, LLC

(57) ABSTRACT

A pressure shoe (1) includes a press surface (2) for directly pressing finishing tape onto a radial circumferential surface (3) of a rotating workpiece section (4) during a finishing process. A plurality of expansion elements (5) is formed in the pressure shoe (1). Each of expansion elements (5) are expandable individually and independently of one another radially while deforming the press surface (2) in a direction of the circumferential surface (3) of the workpiece section (4), so that during the finishing process, the shape of the circumferential surface (3) of the workpiece section can be influenced in a targeted manner via different expansion of the expansion elements (5) distributed over the press surface (2).

10 Claims, 4 Drawing Sheets

(51) Int. Cl.
*B24B 21/16* (2006.01)
*B24B 47/06* (2006.01)

(58) Field of Classification Search
USPC ..... 451/59, 303
See application file for complete search history.

(56) References Cited

U.S. PATENT DOCUMENTS

| | | | | | |
|---|---|---|---|---|---|
| 4,527,359 | A * | 7/1985 | Stump | B23Q 15/02 | 451/300 |
| 4,850,152 | A * | 7/1989 | Heynacher | B24B 13/015 | 451/5 |
| 5,230,184 | A * | 7/1993 | Bukhman | B24B 37/11 | 451/41 |
| 6,607,425 | B1 * | 8/2003 | Kistler | B24B 21/08 | 451/168 |
| 7,335,088 | B1 * | 2/2008 | Hwang | B24B 37/30 | 451/287 |
| 8,517,804 | B2 * | 8/2013 | Weigmann | B24B 21/02 | 451/303 |
| 2004/0244574 | A1 * | 12/2004 | Chao | B24B 47/06 | 91/330 |

FOREIGN PATENT DOCUMENTS

| | | | |
|---|---|---|---|
| EP | 0272362 | A2 | 2/1987 |
| EP | 0802017 | A1 | 10/1997 |
| JP | 2004243481 | A | 9/2004 |
| JP | 2012183637 | A | 9/2012 |
| WO | 2008113925 | A1 | 9/2008 |

* cited by examiner

PRESSURE SHOE WITH EXPANSION CHAMBER

The instant application should be granted the priority dates of Jul. 7, 2016, the filing date of the international patent application PCT/EP2016/066123, and Jul. 10, 2015, the filing date of German Patent Application DE 10 2015 008 814.9.

BACKGROUND OF THE INVENTION

The present invention relates to a pressure shoe with a press surface for directly pressing finishing tape onto a radial circumferential surface of a rotating workpiece section during a finishing process, wherein a plurality of expansion elements, which can be filled with fluid in particular, are formed in the pressure shoe.

A pressure shoe with the previously mentioned features is known from EP 0 802 017 A1, wherein the pressure shoe is provided for processing a circumferential surface of the workpiece section located between collar surfaces. So that the finishing tape located between pressure shoe and workpiece bears against the rounded transitions between circumferential surface and lateral collar surfaces at any time during the relative axial movement between pressure shoe and workpiece, two expansion chambers, which are to be understood as expansion elements are suggested in the region of the transitions at the pressure shoe. The two expansion chambers are loaded with a fluid via a common line during the finishing process. During the finishing process, the fluid flows back and forth between the two expansion chambers owing to the driven relative axial movement between pressure shoe and workpiece, so that the expansion chambers expand in an oscillating manner. Consequently, it is ensured that the finishing tape bears in the transition regions between circumferential surface and collar surfaces and at the collar surfaces. Targeted influencing of the shape of the collar surface or the transition regions between collar surfaces and the circumferential surface is not intended in this case.

There is the desire that during the finishing process, it be possible to influence the shape of the radial circumferential surface of the workpiece section to be processed in a targeted manner, with regards to the crowning and/or non-roundness in particular.

A further pressure shoe is known from WO 2008/113 925 A1, wherein the expansion elements are formed by cylinders, using which, by means of a piston located in the respective cylinder, one pressure element in each case can be loaded in a targeted manner with pressure in the direction of the circumferential surface. As the piston/cylinder units are arranged one behind the other in the circumferential direction, only the targeted creation or removal of non-roundness of a circumferential surface of the workpiece is possible using such a pressure shoe.

In addition, a pressure device is known from DE 196 50 155 C1, in which a pressing device formed as a shell is pivotably mounted. The shell can be pivoted as a function of a measured diameter by means of a piston, as a result of which the shell presses the finishing tape more strongly onto the workpiece on one side of the pivot axis of the shell than on the side opposite the pivot axis, so that the conicity of the workpiece surface is influenced in a targeted manner.

SUMMARY OF THE INVENTION

Therefore, it is the object of the present invention to at least partially solve the problems signposted with reference to the prior art and in particular to specify an alternative pressure shoe and a method for operating a finishing device, using which the shape of the radial circumferential surface of the workpiece section to be processed can be influenced in a targeted manner, wherein it is desirable in particular that different profile shapes of the circumferential surface can be achieved with exactly one pressure shoe.

The object is achieved in particular by means of a pressure shoe with the previously mentioned features, wherein the plurality of expansion elements are in each case expandable individually and independently of one another radially whilst deforming the press surface in the direction of the circumferential surface of the workpiece section, so that during the finishing process, the shape of the circumferential surface of the workpiece section can be influenced in a targeted manner by means of different expansion of the expansion elements distributed over the press surface.

It is therefore provided that energy can be supplied to the expansion elements independently from one another in such a manner that the expansion elements can deform in the axial direction in the axial direction. The expansion elements can particularly be expanded in the radial direction mechanically, electromechanically, thermally, hydraulically or in a different suitable manner. The press surface is deformed by the expansion.

In particular, each expansion element is formed by an expansion chamber, which is in each case connected individually to a line leading out of the pressure shoe and in each case can be expanded radially under pressurization of the fluid whilst deforming the press surface in the direction of the circumferential surface of the workpiece section. In the following, although the expansion element is described in more detail with reference to the expansion chamber which can be expanded by means of fluid, it is not intended that the teaching is limited to expansion chambers. The advantages and effects presented in the following therefore apply in the same manner for differently formed expansion elements, which can be expanded in the radial direction and are not formed by an expansion chamber which can be expanded by means of a fluid.

It is therefore provided in particular that a plurality of expandable expansion chambers, which are different from one another, are provided, using which the profile of the integrally cohesive press surface by means of deformation in the radial direction. Thus, it is possible to achieve that the shape of the press surface of the pressure shoe pressing the finishing tape against the radial circumferential surface can at least be changed locally, which results in it being possible to locally influence the pressure of the finishing tape acting on the circumferential surface. It is therefore possible to predefine the distribution of the pressure over the press surface in a targeted manner, as a result of which the shape of the workpiece section to be processed, which can be achieved by the finishing process, can be influenced.

The pressure shoe is used in a finishing device in particular, which in addition to the pressure shoe comprises a rotational drive for the workpiece to be processed, an oscillating drive for generating a relative oscillating movement in the workpiece longitudinal direction between the workpiece and the pressure shoe, and a finishing tape between the press surface and the radial circumferential surface of the pressure shoe. Thus, the pressure shoe can press the finishing tape onto the circumferential surface of the workpiece during the rotational movement of the workpiece in the axial direction in an oscillating manner. The finishing device in particular also comprises a control unit for carrying out the method according to the invention.

The press surface of the pressure shoe is in particular that surface in the form of a partial ring, which is formed completely flat and directed radially inwards in the direction of the workpiece section to be processed during the processing. The partial ring surface has essentially one radius, which corresponds to the radius of the workpiece section to be processed. A (local) deviation from this radius can be achieved by pressure loading of the expansion chambers.

The expansion chambers are therefore formed in such a manner inside the pressure shoe in particular, that when pressurized, the press surface of the pressure shoe is deformed in the radial direction in the region of the respective expansion chamber. From the pressure-free rest position, the expansion chamber expands under loading of a fluid in the radial direction by at least two μm [micrometres], preferably at least 5 μm, wherein the maximum expansion of the expansion chamber or the deformation of the press surface in the radial direction is at most 50 μm, preferably at most 30 μm.

If the plurality of, preferably at least two, preferably at least five, expansion chambers are in each case connected to a line guided out of the pressure shoe, the expansion chambers can in particular be loaded with different pressures independently of one another, so that the expansion chambers expand to varying degrees in the radial direction and therefore the press surface is deformed locally to varying degrees.

In order to be able to influence the crowning or the conicity of the workpiece section to be processed in a targeted manner, it can be provided that the plurality of expansion chambers run parallel to one another in the circumferential direction along the press surface of the pressure shoe. Preferably, at least five expansion chambers arranged next to one another in the axial direction are provided, which in each case run parallel to one another over the same length in the circumferential direction. The press surface is in particular deformed evenly along the respective expansion chamber. The pressure shoe therefore has the same or a smaller radius in the region of the expanded chamber than before the expansion.

In order to be able to influence the non-roundness of the workpiece section in a targeted manner, it can be provided that the plurality of expansion chambers run parallel to one another in the axial direction along the press surface of the pressure shoe. The preferably at least seven expansion chambers are arranged next to one another in the circumferential direction and extend over the entire length along the press surface.

The object is also achieved by means of a method for operating a finishing device, which in particular comprises the above-listed machine elements, having a pressure shoe according to the invention, comprising at least the following steps:

- pressing a finishing tape onto the radial circumferential surface of the workpiece section to be processed, using the pressure shoe,
- expanding at least one of the plurality of expansion elements, so that the expansion element deforms the press surface in the radial direction.

The effects and advantages of the method presented in the following apply in a suitable manner also for expansion elements, which are not expanded in the radial direction by a pressurized fluid.

In particular, when loading the pressure and/or the volume of the fluid is recorded, so that it is possible to drawn a conclusion about the size of the expansion of the expansion chamber in the radial direction. In this context, it can in particular be provided that a control unit is formed, for which a value for the radial expansion is predefined and which by regulating the pressure in the expansion chamber and/or the volume in the expansion chamber, sets the predetermined radial expansion of the respective expansion chamber.

In particular, the fluid is a liquid or a gas.

Preferably all expansion chambers are loaded independently of one another using a fluid, so that the expansion chambers expand to varying degrees in the radial direction. In particular, the expansion chambers are loaded with pressure in such a manner that the outer expansion chambers experience the greatest radial expansion and the inner expansion chambers experience the lowest radial expansion.

In this context, it is preferred that the expansion of the at least one expansion chamber is kept constant during the finishing process. This is preferred in particular, if the expansion chambers run parallel to one another in the circumferential direction, and thus the crowning or conicity of the workpiece section to be processed is predefined by the expansion of the expansion chambers. In particular, it is possible to monitor whether the pressure and/or the volume of the fluid in the expansion chamber corresponds to the desired values, wherein it is possible to readjust in the event of deviations.

In particular, it is provided that the expansion of adjacent expansion chambers is different so that a shape of the circumferential surface of the workpiece section to be processed, which can be achieved by means of the finishing process, is predefined by the different expansion.

In particular, if the expansion chambers run in the axial direction for influencing the non-roundness of the workpiece section to be processed, it can be provided that the expansion of each expansion chamber is changed in each case during the finishing process. In order to predefine a shape for the desired non-roundness, it is provided here in particular that the expansion of each expansion chamber is changed as a function of the rotational position of the workpiece section. The expansion of the expansion chambers is regulated in such a manner in this case that when a predetermined circumferential location bears against an expansion chamber, the radial expansion of this expansion chamber is always minimal, whilst when a circumferential location which is offset thereto bears against the expansion chambers, the expansion chambers are expanded to the maximum extent in each case. The expansion of the expansion chambers takes place in such a manner in this case, that a circumferential location which is to be ablated slightly is in each case only loaded with a low pressure by means of the respective expansion chamber, whilst a circumferential location which is to be ablated more strongly is in each case loaded with a larger pressure by the respective expansion chamber. It is to be understood that during the processing, a finishing tape is always arranged between the press surface of the pressure shoe and circumferential surface of the workpiece section to be processed.

In particular, if the plurality of expansion chambers run in the circumferential direction, it can be provided for targeted influencing of the crowning or conicity of the workpiece section to be processed that the expansion of each expansion chamber is changed as a function of the relative axial position between pressure shoe and workpiece section. Thus, it is achieved that the press surface is adjusted to the crowning during the relative axial movement.

BRIEF DESCRIPTION OF THE DRAWINGS

The invention and the technical field are described in the following on the basis of the figures, wherein it should be pointed out that the figures show preferred embodiments of the invention. In the figures

DETAILED DESCRIPTION OF SPECIFIC EMBODIMENTS

Figure 1:
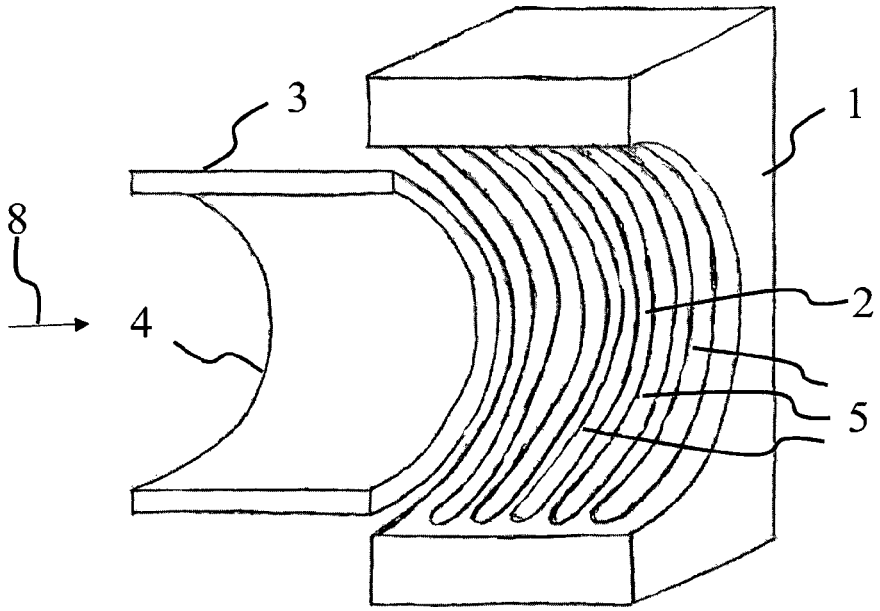
FIG. 1: schematically shows a pressure shoe and a workpiece section.

FIG. 1 shows a pressure shoe 1 with a radially inwardly directed press surface 2 with a partial-ring-shaped construction. In the pressure shoe 1, the expansion elements are formed as indicated expansion chambers 5. The expansion chambers 5 are arranged next to one another in the axial direction 8 and run parallel to one another in the circumferential direction 7.

During the finishing process, a finishing tape, which is not shown, is arranged between the press surface 2 and a radial circumferential surface 3 of a workpiece section 4, which is only indicated. During the finishing process, the workpiece section 4 rotates about a rotational axis, whilst the workpiece section 4 and the pressure shoe 1 oscillate relatively to one another in the axial direction 8, wherein the finishing tape, which is not shown, is pressed by the press surface 2 of the pressure shoe 1 onto the radial circumferential surface 3 of the workpiece section 4 for cutting ablation.

Figure 2:
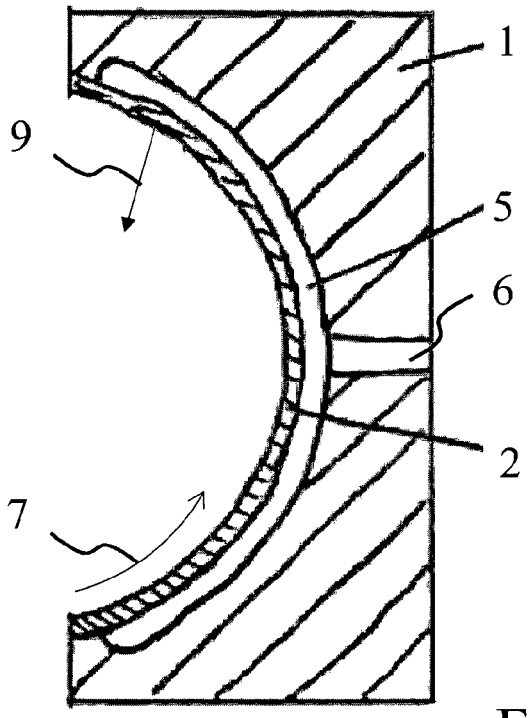
FIG. 2: schematically shows the pressure shoe in longitudinal section.

It becomes clear from the longitudinal section, illustrated in FIG. 2, through the pressure shoe 1 in the region of an expansion chamber 5, that each expansion chamber 5 is connected to a line 6 leading out of the pressure shoe 1 individually, so that the expansion chambers 5 can be loaded with a fluid independently of one another. If the expansion chamber 5 is loaded with a fluid, then the expansion chamber 5 expands in the radial direction 9 with the section of the press surface 2 assigned to the expansion chamber. As the expansion chambers 5 can expand independently of one another, the profile of the press surface 2 can be adjusted along the axial direction 8, so that the crowning of the workpiece section 4 can be influenced in a targeted manner.

Figure 3:
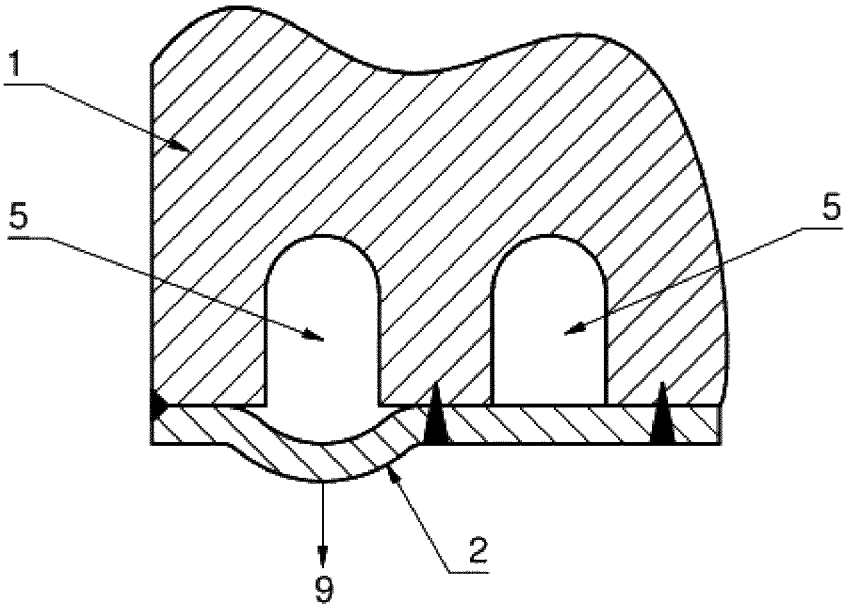
FIG. 3: schematically shows a cross section through expansion chambers of the pressure shoe.

A cross section through two expansion chambers 5 is illustrated in FIG. 3, wherein only the left expansion chamber 5 is loaded with a fluid, so that the expansion chamber 5 is expanded in the radial direction 9.

Figure 4:
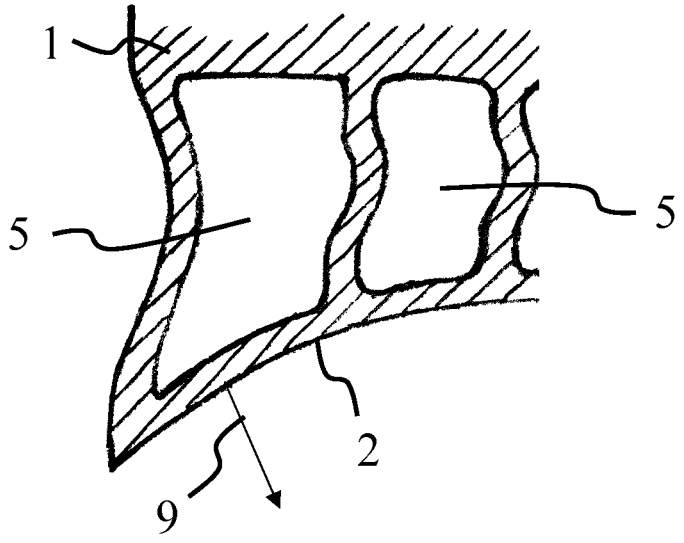
FIG. 4: schematically shows a cross section through a further embodiment of the expansion chambers.

An alternative design of the expansion chambers 5 is illustrated in FIG. 4. The expansion chambers 5 are formed with a bellows-shaped cross section, so that a larger expansion can be achieved in the radial direction 9. In FIG. 4 also, only the left expansion chamber 5 is loaded with a fluid.

Alternatively, it can also be provided that the expansion chambers 5 run parallel to one another in the axial direction 8 and are arranged next to one another in the circumferential direction 7. In an arrangement of the expansion chambers 5 of this type, the non-roundness of the circumferential surface 3 of the workpiece section 4 to be processed can be influenced in a targeted manner.

The application of force to the circumferential surface 3 of the workpiece section 4 by the expansion chambers 5 of the pressure shoe 1 in such a targeted processing of the non-roundness is illustrated in FIGS. 5 to 8. Here, the workpiece section 4 is oval.

Figure 5:
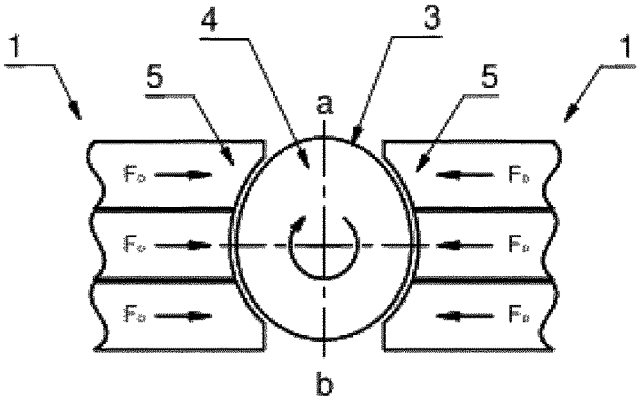
FIGS. 5 to 8: schematically shows a workpiece section during the finishing process for targeted creation of non-roundness.
Figure 6:
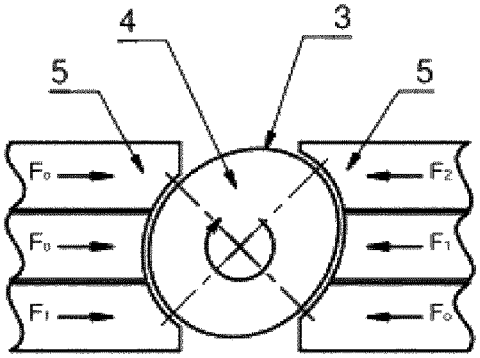
Figure 7:
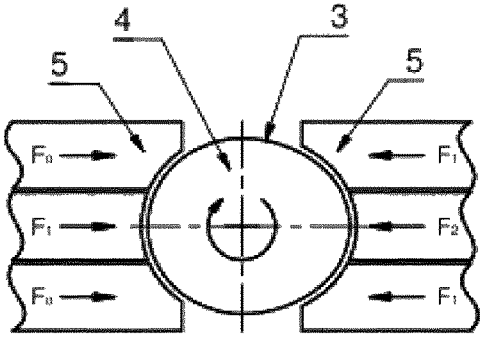
Figure 8:
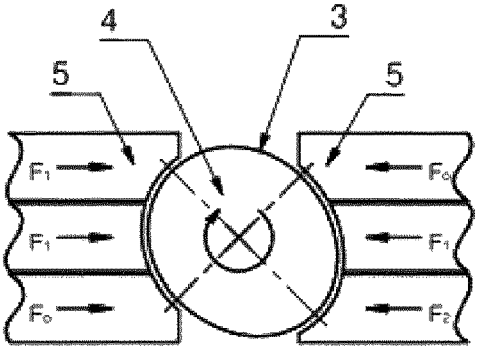

Whilst, in the alignment illustrated in FIG. 5, all expansion chambers 5 are expanded to the maximum extent, the expansion of each individual expansion chamber 5 is adapted to the desired non-roundness during the rotation of the workpiece section 4, wherein $F_0$ is larger than $F_1$ and $F_1$ is larger than $F_2$. Thus, in FIG. 6, the expansion of the expansion chambers 5 is shown after a rotation through 45°, in FIG. 7 after a rotation through 90° and in FIG. 8 after a rotation through 135°.

Thus, for example, the expansion of the upper expansion chamber 5 of the right pressure shoe 1 is lowest for a rotation through 45° (FIG. 6) and continues to increase until the rotation angle of 135° (FIG. 8) is reached.

The expansion of the upper expansion chamber 5 of the left pressure shoe 1 is by contrast initially at the maximum for the rotation from 0° to 90° and is reduced slightly until the rotation angle of 135° is reached.

The present invention is connected with the advantage that the shape of a circumferential surface 3 of a workpiece section 4 can be influenced in a targeted manner by a finishing process using the pressure shoe 1.

The specification incorporates by reference the disclosure PCT/EP2016/066123, filed Jul. 7, 2016, and DE 10 2015 008 814.9, filed Jul. 10, 2015.

The present invention is, of course, in no way restricted to the specific disclosure of the specification and drawings, but also encompasses any modifications within the scope of the appended claims.

REFERENCE LIST

1 Pressure shoe
2 Press surface
3 Circumferential surface
4 Workpiece section
5 Expansion chamber
6 Line
7 Circumferential direction
8 Axial direction
9 Radial direction

The invention claimed is:

1. A pressure shoe (1), comprising:

a press surface (2) for directly pressing finishing tape onto a radial circumferential surface (3) of a rotating workpiece section (4) during a finishing process;

a plurality of expansion elements (5) being formed in the pressure shoe (1), wherein each of the plurality of expansion elements (5) are expandable individually and independently of one another radially while deforming the press surface (2) in a direction of the circumferential surface (3) of the workpiece section (4), so that during the finishing process, the shape of the circumferential surface (3) of the workpiece section can be influenced in a targeted manner by different expansion of the expansion elements (5) distributed over the press surface (2), wherein each expansion element is formed by a respective expansion chamber (5), wherein each expansion chamber (5) is connected individually to a line (6) leading out of the pressure shoe (1) and is expandable radially under pressurization of the fluid while deforming the press surface (2) in a direction of the circumferential surface (3) of the workpiece section (4).

2. The pressure shoe (1) according to claim 1, wherein the plurality of expansion elements (5) run parallel to one another in a circumferential direction (7) along the press surface (2) of the pressure shoe (1).

3. The pressure shoe (1) according to claim 1, wherein the plurality of expansion elements (5) run parallel to one another in an axial direction (8) along the press surface (2) of the pressure shoe (1).

4. The pressure shoe (1) according to claim 1, wherein the expansion of the expansion elements (5) in a radial direction (9) is at most 50 μm.

5. A method for operating a finishing device with a pressure shoe (1), comprising at least the following steps:

providing a pressure shoe (1), comprising:

a press surface (2) for directly pressing finishing tape onto a radial circumferential surface (3) of a rotating workpiece section (4) during a finishing process;

a plurality of expansion elements (5) being formed in the pressure shoe (1), wherein each of the plurality of expansion elements (5) are expandable individually and independently of one another radially while deforming the press surface (2) in a direction of the circumferential surface (3) of the workpiece section (4), so that during the finishing process, the shape of the circumferential surface (3) of the workpiece section can be influenced in a targeted manner by different expansion of the expansion elements (5) distributed over the press surface (2), wherein each expansion element is formed by a respective expansion chamber (5), wherein each expansion chamber (5) is connected individually to a line (6) leading out of the pressure shoe (1) and is expandable radially under pressurization of the fluid while deforming the press surface (2) in a direction of the circumferential surface (3) of the workpiece section (4);

pressing a finishing tape onto the radial circumferential surface (3) of the workpiece section (4) to be processed, using the pressure shoe (1); and expanding at least one of the plurality of expansion elements (5), so that the expansion element (5) deforms the press surface (2) in a radial direction.

6. The method according to claim 5, wherein the expansion of the at least one expansion element (5) is kept constant during the finishing process.

7. The method according to claim 5, wherein the expansion of adjacent expansion elements (5) is different.

8. The method according to claim 5, wherein the expansion of each expansion element (5) is changed in each case during the finishing process.

9. The method according to claim 8, wherein the expansion of each expansion element (5) is changed as a function of the rotational position of the workpiece section (4).

10. The method according to claim 7, wherein the expansion of each expansion element (5) is changed as a function of the relative axial position between pressure shoe (1) and workpiece section (4).

* * * * *